US009906848B2

(12) United States Patent
Huang

(10) Patent No.: US 9,906,848 B2
(45) Date of Patent: Feb. 27, 2018

(54) LOUDSPEAKER AND MANUFACTURING METHOD THEREFOR

(75) Inventor: Hsinmin Huang, Ningbo (CN)

(73) Assignee: Tang Band Industries Co., Ltd., Ningbo, Zhejiang (CN)

( * ) Notice: Subject to any disclaimer, the term of this patent is extended or adjusted under 35 U.S.C. 154(b) by 169 days.

(21) Appl. No.: 14/370,057

(22) PCT Filed: Apr. 12, 2012

(86) PCT No.: PCT/CN2012/073888
§ 371 (c)(1),
(2), (4) Date: Jun. 30, 2014

(87) PCT Pub. No.: WO2013/097378
PCT Pub. Date: Jul. 4, 2013

(65) Prior Publication Data

US 2014/0369546 A1 Dec. 18, 2014

(30) Foreign Application Priority Data

Dec. 31, 2011 (CN) ..... 2011 1 0460094
Dec. 31, 2011 (CN) ..... 2011 2 0575402 U

(51) Int. Cl.
*H04R 1/02* (2006.01)
*H04R 1/28* (2006.01)
*H04R 31/00* (2006.01)

(52) U.S. Cl.
CPC ..... *H04R 1/026* (2013.01); *H04R 1/2834* (2013.01); *H04R 31/006* (2013.01); (Continued)

(58) Field of Classification Search
CPC ... H04R 5/04; H04R 5/02; H04R 1/02; H04R 2499/11; H04R 2420/07; H04R 27/00; (Continued)

(56) References Cited

U.S. PATENT DOCUMENTS

2004/0231911 A1* 11/2004 Welker ..... H04R 1/26 181/165
2012/0279796 A1* 11/2012 Lin ..... H04R 7/24 181/148

* cited by examiner

*Primary Examiner* — Rasha Al Aubaidi
(74) *Attorney, Agent, or Firm* — Raymond Y. Chan; David and Raymond Patent Firm

(57) ABSTRACT

The present invention relates to a speaker box module, and particularly relates to a loudspeaker that produces sound through the mechanical vibration generated by electromagnetic force and a manufacturing method therefor. The loudspeaker comprises a speaker box module which comprises a speaker, a passive radiator and a speaker box panel, wherein a mounting hole is arranged in the speaker box panel; the speaker is arranged in the mounting hole and is integrated with the speaker box panel by means of insert injection molding; a secondary mounting hole is arranged in the speaker box panel at one side of the mounting hole; and the passive radiator is arranged in the secondary mounting hole and is integrated with the speaker box panel by means of insert injection molding. The loudspeaker is small and thin, structurally simple, and enhances bass, and can be used as a built-in speaker or an external speaker for modern tablet computers or smart phones, and the like. In order to ensure that the speaker box has excellent acoustic effect, the present invention uses an insert injection integrated manufacturing process, which ensures maximum acoustic effect of the speaker box while greatly reducing man-hours and thereby increasing production efficiency.

9 Claims, 3 Drawing Sheets

(52) U.S. Cl.
CPC ..... *H04R 1/2888* (2013.01); *H04R 31/003* (2013.01); *H04R 2201/025* (2013.01); *H04R 2201/029* (2013.01); *H04R 2231/001* (2013.01); *Y10T 29/49005* (2015.01)

(58) Field of Classification Search
CPC ..... H04S 2400/11; H04S 7/30; H04S 7/302; H04S 7/303
USPC ..... 381/79, 82, 300–305, 386
See application file for complete search history.

LOUDSPEAKER AND MANUFACTURING METHOD THEREFOR

CROSS REFERENCE OF RELATED APPLICATION

This is a non-provisional application that claims the benefit of priority under 35 U.S.C. § 119 and 35 U.S.C. § 371 to a non-provisional application, application number PCT/CN2012/073888, filed Apr. 12, 2012.

BACKGROUND OF THE PRESENT INVENTION

Field of Invention

The present invention relates to a speaker box module, and particularly relates to a loudspeaker that produces sound through the mechanical vibration generated by electromagnetic force and a manufacturing method therefor.

Description of Related Arts

A speaker, also known as loudspeaker, is a electric-sound device for converting electrical energy into sound energy. A speaker actuates a vibration of the ambient air thereof by a mechanical vibration so as to achieve an energy conversion.

Most of speakers used for Hi-Fi Audio generally are dynamic loudspeakers, at the same time, in order to good sound effects, a passive radiator is frequently provided on the speaker box; current conventional techniques only couples the passive radiator with the speaker box by a screw jointing manner simply so as to improve bass effects, the auxiliary bass effect of the audio made by the above method is less than satisfactory, if want to improve the tone quality thereof, the size of the speaker would have to be enlarged, but now the speaker box has a bigger size, which is inconvenient to carry and takes up a substantially big space when arranged; apart from the above passive radiator provided by a screw jointing manner, another installing method for the passive radiator is glue bonding method, but the glue bonding method is troublesome to operate, needs higher machining requirements, time-consuming and takes a lot of work, and after a long time, the glue layer is easy to be aging, which affects the quality of the sound.

Multiple tablet computers and smart phones become thinner, lighter and more artful, in the meantime, these electronic digital products are required to have a high quality of sound effect. But current speakers have a considerable thickness, so it is a problem being faced by current speakers to reduce the thickness of the current speakers and enable the current speakers to provide good sound effects concurrently.

At the same time, the bad sound effects of speaker embodied in most of thin-type tablet computers and smart phones do not meet the demand of the modern people.

SUMMARY OF THE PRESENT INVENTION (1) The Technical Problems to be Solved

The object of the present invention is to provide a built-in or external loudspeaker being small in size, thin in thickness, simple in structure, and having a improved bass effect, which is direct to the above problems of the prior art and can be used for modern tablet computers and smart phones; at the same time, the loudspeaker is ensured provide a very good sound effect.

Another object of the present invention is to provide a manufacturing method for a loudspeaker: employing a injecting manufacturing process for integrally and insertedly connecting together a speaker, a passive radiator and a speaker box panel so as to define a speaker box module, and the speaker box module has a chamber sized and designed corresponding to the parameter characteristics of the speaker and the passive radiator so as to provide a perfect sound quality performance, which not only furthest ensure the sound quality of the audio, but also modern manufacturing process and mould technology employed greatly reduce man-hours and increase production efficiency.

Another object of the present invention is to match a suited passive radiator and a back chamber body according to the parameters and appearances of various speakers having different sizes so as to define various selectable speaker box modules and enable a media manufacturer to select a desired speaker box module from the various selectable speaker box modules so that the media manufacturer only need to design corresponding outer casing additionally and arrange the speaker box module in the self-designed casings having various appearances directly, and assemble various functional modules, for example a Bluetooth module, a wireless module and an amp module to make a portable loudspeaker box being powerful in function, small in size and having an excellent sound quality. These designers do not know acoustics, who can easily design desired speaker boxes.

(2) The Technical Solution for Solving the Above Technical Problems

In order to solve the above problem, the loudspeaker of the present invention comprises a speaker box module, wherein the speaker box module comprises a speaker, a passive radiator and a speaker box panel, wherein:

The above speaker box has a mounting hole provided therein, the above speaker is provided in the mounting hole and integrated with the speaker box panel by means of insert injection molding; a secondary mounting hole is arranged in the speaker box panel at one side of the mounting hole; and the above passive radiator is arranged in the secondary mounting hole and is integrated with the speaker box panel by means of insert injection molding.

As an optimized, the above speaker comprises a vibrating diaphragm, a surround and an outer frame, wherein the vibrating diaphragm, the surround and the outer frame are integrated with each other by an integrally injection molding; and the vibrating diaphragm and the speaker box panel are molded by means of insert injection molding.

As an optimized, the above speaker further comprises a voice coil and a speaker magnetic circuit, wherein a vibrating cone paper of the above speaker is connected with the voice coil and the speaker magnetic circuit.

As an optimized, the above passive radiator comprises a rubber surround and a weighting block, wherein the rubber surround and the weighting block are integrated with each other by means of injection molding, and the rubber surround covers on the weighting block.

As an optimized, the speaker further has a back chamber body matching the above speaker box panel.

As an optimized, the speaker further comprises a frame, wherein the above speaker box module is provided on the frame, wherein the frame comprises an upper frame and an lower frame, wherein the upper frame and the lower frame are connected with each other by a hinge joint, wherein the lower frame has an arranging groove corresponding to the upper frame, and the upper frame has a module installing hole, wherein the upper frame has a side, wherein the side of the upper frame has a slot provided in the side, wherein the slot is communicated with the module installing hole, wherein the above back chamber body has two end faces, wherein each of the end faces comprises a fixing block for engaging fittedly with the slot, wherein the above speaker box module is provided in the module installing hole and is fastened by a bolt.

As an optimized, a bottom of the above arranging groove has a receiving groove provided thereon, wherein the receiving groove is corresponding to the speaker and the passive radiator.

At the same time, the present invention further provides a manufacturing method for a loudspeaker:

a) molding integrally the vibrating diaphragm of the speaker, the surround and the outer frame by injecting to define a vibrating cone paper;

b) putting the weighting block in a mold, covering rubber material on the weighting block by an injection process to define the rubber surround and the passive radiator connected with the rubber surround, at the same time.

c) putting the vibrating cone paper and the passive radiator in a mold for the speaker box panel, making the speaker box panel by an insert injection molding, wherein the vibrating cone paper, the passive radiator and the speaker box panel are integrally molded to define an integrated structure by the insert injection so as to define a speaker box panel module with a vibrating cone paper and a passive radiator;

d) putting the magnetic circuit components of the speaker and making them define an integrated structure by an insert injection in a mold so as to define a magnetic circuit system;

e) assembling the magnetic circuit system and the vibrating cone paper, and fitting the magnetic circuit system and the vibrating cone paper together in the speaker box panel by fastening, locking screws, ultrasonic wave or hot melting so as to define a speaker box module with a speaker having a complete structure;

f) preparing a back chamber body matching the speaker box panel by a special injection molding;

g) mounting the speaker box module in the back chamber and make the speaker box module fit the back chamber completely, and making the speaker box module be integrated with the speaker box panel so as to define a speaker box module with a back chamber, which has a complete structure;

h) assembling the whole speaker box module on a frame and fastening the speaker box module on a frame by a bolt.

The above speaker panel is respectively integrated with the vibrating cone paper and the passive radiator by an insert injection molding.

The above speaker box panel is combined and fastened in the back chamber body by ultrasonic wave melting, snap joints, hot melting or riveting.

Advantages of the Present Invention

The present invention merges the speaker, the passive radiator and the speaker box panel together and makes the speaker, the passive radiator and the speaker box panel be integrated together by an insert injecting. The size of the speaker box is minimized and thinned, and the dimension of the speaker box is also greatly reduced. Furthermore, the surface assembling problems can be avoided, for the speaker box do not need one screw provided in a surface thereof, and the speaker, the passive radiator and the speaker box panel have an integrated structure to solve the assembling problems, while the conventional assembling operation need locking screws and a depth and a place provided for mounting, which increase the size of the speaker box.

So the present invention is smart in size, thin in depth, simple in structure and employs a passive radiator designed for increasing bass effects, which may be used as a build-in speaker or an external speaker for modern panel computers or smart phones; at the same time, in order to ensure the speaker be capable of providing a good sound effect, the present invention utilizes an integrally manufacturing process of insert injection molding, which ensures maximum acoustic effect of the speaker box while greatly reducing man-hours and thereby increasing production efficiency.

The present invention can employ a mechanization and automation production process as its main production process, each of components is designed to have a special structure so that the whole speaker do not need any screws and all of components provided in surfaces of the speaker is provided by an insert-type arrangement, which does not use chemical glue products, is green and environment protecting and employs a plenty of macromolecule materials. And the present invention has a stable performance and a high reliability.

The present invention can match a fitting passive radiator and a back chamber body so as to define various speaker box module having different sizes and dimensions, after assembling Bluetooth, wireless, and amps module and so on with the speaker box module, a portable loudspeaker having powerful functions, a very small size and very good sound quality. These designers do not know acoustics, who can easily design desired speaker boxes.

Additional advantages and features of the invention will become apparent from the description which follows, and may be realized by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

In Figs, 1 representing a speaker, 2 representing a passive radiator, 3 representing a speaker box panel, 4 representing a mounting hole, 5 representing a secondary mounting hole, 6 representing a rubber surround, 7 representing a weighting block, 9 representing a back chamber body, 10 representing an upper frame, 11 representing a lower frame, 12 representing an arranging groove, 13 representing a module installing hole, 14 representing an arranging groove, 15 representing a fixing block, 16 representing a receiving groove, 17 representing a Bluetooth module.

DETAILED DESCRIPTION OF THE PREFERRED EMBODIMENT

Figure 1:
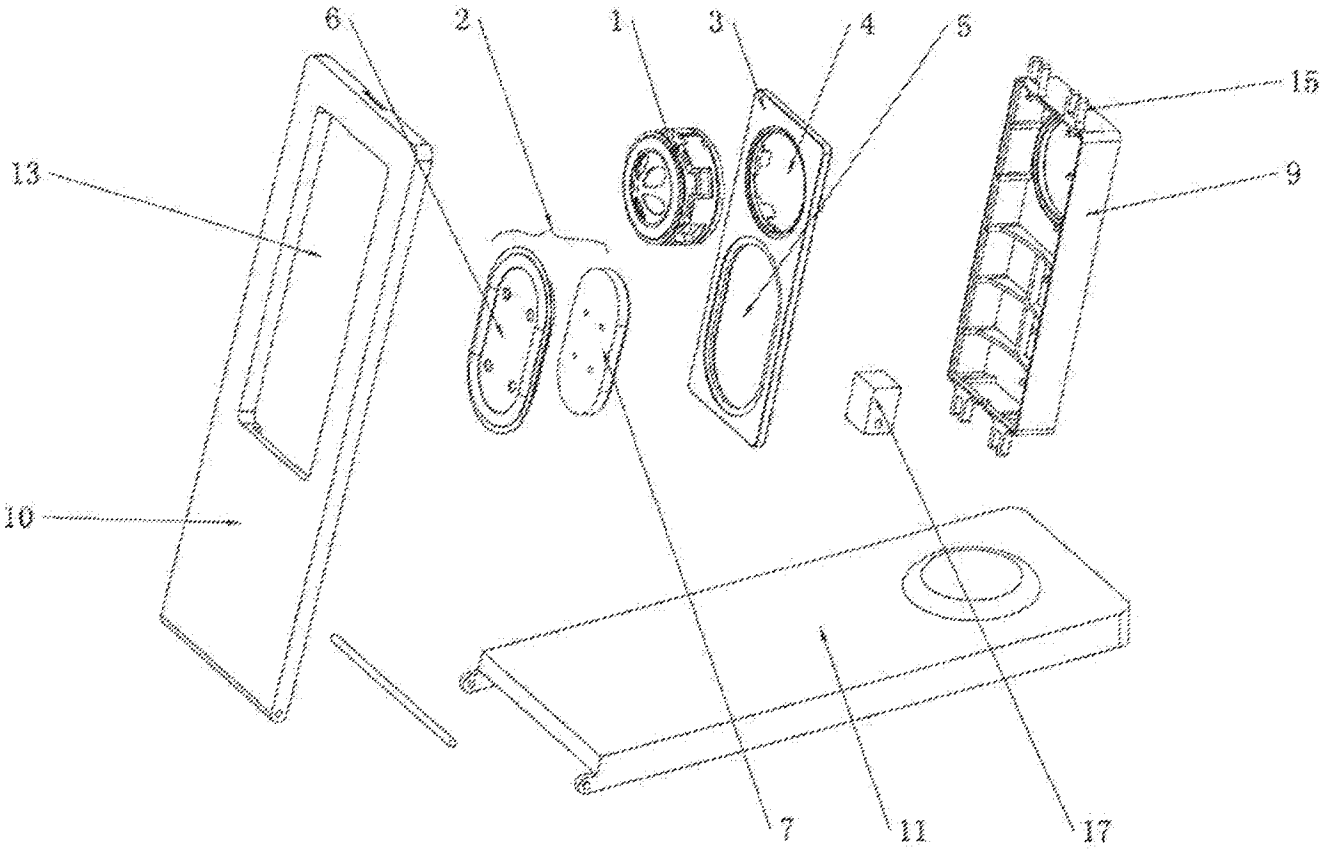
FIG. 1 is a first exploded view of the loudspeaker of the present invention.
Figure 2:
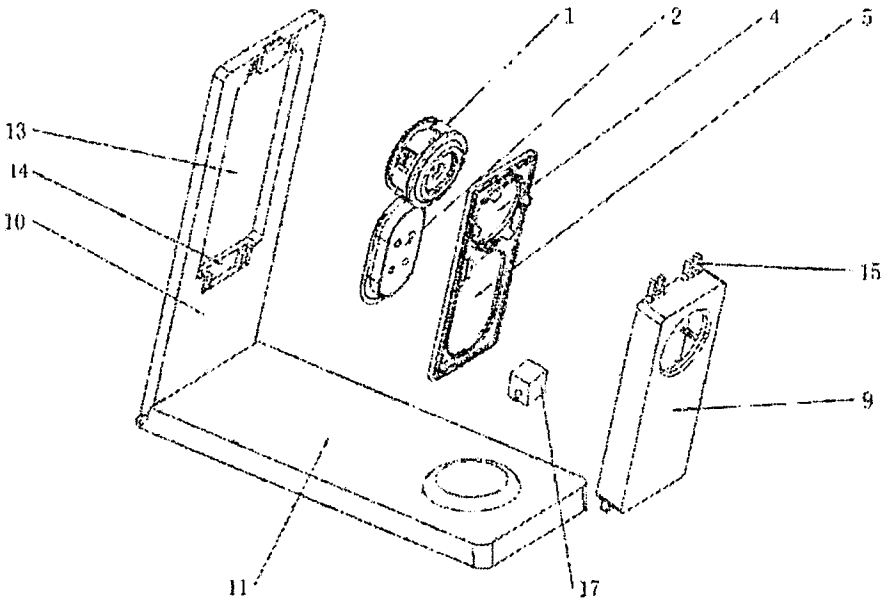
FIG. 2 is a second exploded view of the loudspeaker of the present invention.
Figure 3:
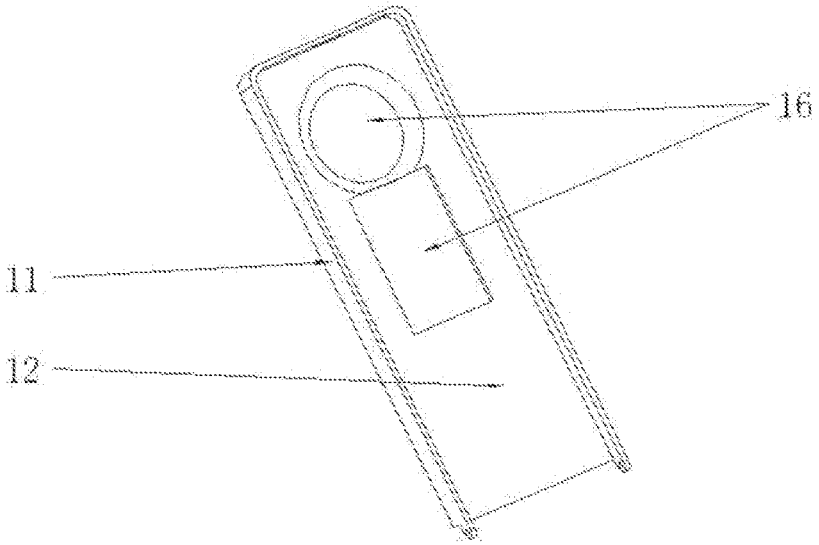
FIG. 3 is a perspective view of the lower frame of the loudspeaker of the present invention.
Figure 4:
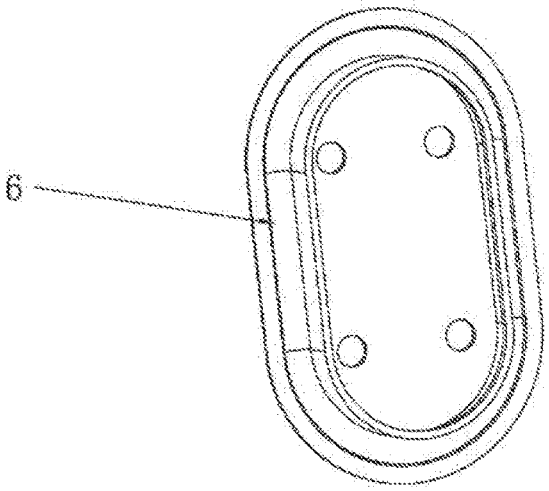
FIG. 4 is a perspective view of the rubber surround of the loudspeaker of the present invention.

As shown in FIG. 1 to FIG. 4, the loudspeaker of the present invention comprises a speaker box module, wherein the speaker box module comprises a speaker 1, a passive radiator 2 and a speaker box panel 3, wherein:

The speaker box panel 3 has a mounting hole 4 provided therein, wherein the speaker 1 is provided in the mounting hole 4 and integrated with the speaker box panel 3 by an insert injection molding; a secondary mounting hole 5 is arranged in the speaker box panel 3 at one side of the mounting hole 4; and the passive radiator 2 is arranged in the secondary mounting hole 5 and is integrated with the speaker box panel 3 by an insert injection molding; the speaker 1 comprises a vibrating diaphragm, a surround and an outer frame, wherein the vibrating diaphragm, the surround and the outer frame define a vibrating cone paper by an integrally injecting; the vibrating diaphragm and the speaker box panel 3 are integrated with each other by an insert injection molding; the speaker 1 further comprises a voice coil and a magnetic circuit system therefor, the vibrating cone paper of the speaker 1 is connected with the voice coil and the magnetic system of the speaker 1.

The passive radiator 2 comprises a rubber surround 6 and a weighting block 7, wherein the rubber surround 6 and the weighting block 7 are integrated with each other by means of injection molding, and the rubber surround 6 covers on the weighting block 7.

The loudspeaker further has a back chamber body 9 matching the speaker box panel 3, wherein the back chamber body 9 has a through-hole for receiving the speaker 1; wherein the speaker 1 and the passive radiator 2 are mostly provided in the back chamber body 9.

The speaker box module according to the present embodiment is provided on the frame, wherein the frame comprises an upper frame 10 and a lower frame 11, wherein the upper frame and the lower frame are connected with each other by a hinge joint, wherein the lower frame 11 has an arranging groove 12 corresponding to the upper frame 10, and the upper frame 10 has a module installing hole 13, wherein the upper frame 10 has a side, wherein the side of the upper frame 10 has a slot 14 provided in the side, wherein the slot is communicated with the module installing hole 13, wherein the back chamber body 9 has two end faces, wherein a plurality of fixing blocks 15 for engaging fittedly with the slot 14 are provided with the end faces of the back chamber body 9, wherein the speaker box module is provided in the module installing hole 13 and is fastened by a bolt; wherein a protrusion is provided in the slot 14, and the protrusion has a threaded hole provided an upper surface thereof, wherein the back chamber body 9 assembled with the speaker box module is provided in the module installing hole 13, and the fixing blocks 15 provided with the end faces of the back chamber body 9 are respectively provided in the slot 14 and tightly fastened by a bolt (bolts) so as to prevent the back chamber body 9 with a speaker box module dropping off.

The upper frame 10 and the lower frame 11 are hinged together by a pin.

The speaker 1 and the passive radiator, which are provided in the speaker box panel 3, provided on the speaker box panel 3 protrude from the upper surface of the speaker box panel 3, and a receiving groove 16 is provided in the arranging groove 12 of the upper frame 11, which matches the speakers 1 and the passive radiator 2. One receiving groove 16 matching the speaker 1 has a round shape, and another receiving groove 16 matching the passive radiator 2 has a rectangle shape.

A connecting mode is provided on one side of the speaker box module, which is connected with the speaker 1 and has a connecting hole for communicating with a data wire of an electronic product such that the speaker is used as an external speaker for the electronic product.

Furthermore, the connecting mode is a Bluetooth mode, which can wirelessly communicate with the electronic product by the Bluetooth.

A manufacturing method for loudspeaker:

a) molding integrally the vibrating diaphragm of the speaker 1, the surround and the outer frame by injecting to define a vibrating cone paper;

b) putting the weighting block 7 in a mold, covering rubber material on the weighting block by an injection process to define the rubber surround 6 and the passive radiator 2 connected with the rubber surround, at the same time.

c) putting the vibrating cone paper and the passive radiator 2 in a mold for the speaker box panel 3, making the speaker box panel 3 by insert injection molding, wherein the vibrating cone paper, the passive radiator 2 and the speaker box panel 3 are integrally molded to define an integrated structure by the insert injection so as to define a speaker box panel module with a vibrating cone paper and a passive radiator 2;

d) putting the magnetic circuit components of the speaker 1 and making them define an integrated structure by insert injection in a mold so as to define a magnetic circuit system.

e) assembling the magnetic circuit system and the vibrating cone paper, and fitting the magnetic circuit system and the vibrating cone paper together in the speaker box panel by fastening, locking screws, ultrasonic wave or hot melting so as to define a speaker box module with a speaker 1 having a complete structure;

f) preparing a back chamber body 9 matching the speaker box panel 3 by a special injection molding;

g) mounting the speaker box module in the back chamber and make the speaker box module fit the back chamber completely, and making the speaker box module be integrated with the speaker box panel so as to define a speaker box module with a back chamber, which has a complete structure;

h) assembling the whole speaker box module on a frame and fastening the speaker box module on a frame by a bolt.

The speaker box panel is integrated with the vibrating cone paper and the passive radiator 2 by an insert injecting; the speaker box panel 3 is combined with and fastened in the back chamber body 9 by ultrasonic wave melting, snap joints, hot melting or riveting so as to define a whole speaker box module.

The above description is only a preferred embodiment of the present invention. It should be mentioned that the present invention is equivalent to conduct various changes and modifications, without departing from the technical principle of the present invention. These changes and modifications are still within the scope of patent protection.

What is claimed is:

1. A loudspeaker, comprising a speaker box module, wherein said speaker box module comprises:

a speaker box panel having an upper surface;

a speaker comprising a vibration diaphragm injection-molded to said upper surface of said speaker box panel to integrally couple said speaker on said speaker box panel; and a passive radiator comprising a passive radiator surround injection-molded to said upper surface of said speaker box panel to integrally couple said passive radiator surround on said speaker box panel at a position adjacent to said speaker;

a back chamber body having a size and shape matching with said speaker box panel, wherein said back chamber body has a through hole arranged in such a manner that when said back chamber body is coupled at a lower surface of said speaker box panel, said speaker is received within said through hole of said back chamber body; and a frame for supporting said speaker box module, wherein said frame comprises an upper frame and an lower frame hinged with said upper frame, wherein said upper frame has a module installing hole receiving said speaker box panel, and at least a slot formed at a rear side of said upper frame and communicated with said module installing hole, wherein said back chamber body has at least a fixing block extended from an end face of said back chamber body to engage with said slot to secure said speaker box panel at said module installing hole.

2. The loudspeaker, as recited in claim 1, wherein said speaker box panel has a mounting hole and a secondary mounting hole, wherein said vibration diaphragm injection-molded to said speaker box panel at said mounting hole thereof, and said passive radiator surround injection-molded to said speaker box panel at said secondary mounting hole thereof.

3. The loudspeaker, as recited in claim 2, wherein said speaker further comprises an outer frame and a speaker surround integrally formed with said vibration diaphragm to form a vibrating cone paper to be injection-molded on said speaker box panel.

4. The loudspeaker, as recited in claim 3, wherein said speaker further comprises a voice coil and a magnetic circuit system, wherein said vibrating cone paper is connected with said voice coil and said magnetic circuit system to form said speaker.

5. The loudspeaker, as recited in claim 4, wherein said passive radiator further comprises a weighting block, wherein said passive radiator surround is injection-molded on said weighting block to integrally cover said weighting block within said secondary mounting hole.

6. The loudspeaker, as recited in claim 3, wherein said passive radiator further comprises a weighting block, wherein said passive radiator surround is injection-molded on said weighting block to integrally cover said weighting block within said secondary mounting hole.

7. The loudspeaker, as recited in claim 1, wherein said lower frame has an arranging groove to receive said upper frame when said upper frame is moved to said lower frame, and two receiving grooves formed on said lower frame within said arranging groove to respectively receive said speaker and said passive radiator being protruded from said speaker box panel.

8. The loudspeaker, as recited in claim 7, wherein said speaker box module is manufactured by a method comprising the steps of:

(a) placing said vibration diaphragm of said speaker and said passive radiator surround of said passive radiator in a mold; and (b) forming said speaker box panel in said mold by insert injection molding to integrally couple said vibration diaphragm and said passive radiator surround to said upper surface of said speaker box panel.

9. The loudspeaker, as recited in claim 1, wherein said speaker box module is manufactured by a method comprising the steps of:

(a) placing said vibration diaphragm of said speaker and said passive radiator surround of said passive radiator in a mold; and (b) forming said speaker box panel in said mold by insert injection molding to integrally couple said vibration diaphragm and said passive radiator surround to said upper surface of said speaker box panel.

* * * * *